US006119314A

United States Patent [19]

Freed

[11] Patent Number: 6,119,314

[45] Date of Patent: Sep. 19, 2000

[54] MULTI-FUNCTION TIE

[76] Inventor: Anna B. Freed, 185 E. 85th St., New York, N.Y. 10028

[21] Appl. No.: 09/265,726

[22] Filed: Mar. 9, 1999

[51] Int. Cl.[7] ..... B65D 63/00; B65D 77/00; F16L 33/00

[52] U.S. Cl. ..... 24/16 PB; 24/17 AP; 24/30.5 P

[58] Field of Search ..... 24/16 PB, 17 AP, 24/30.5 P

[56] References Cited

U.S. PATENT DOCUMENTS

| | | | |
|---|---|---|---|
| 880,116 | 2/1908 | Arnow . | |
| 1,907,778 | 5/1933 | Freysinger . | |
| 2,138,542 | 11/1938 | Goldberg . | |
| 3,200,464 | 8/1965 | Cousins | 24/230 |
| 3,224,056 | 12/1965 | Joffe | 24/16 |
| 3,422,499 | 1/1969 | Merser | 24/16 |
| 3,653,099 | 4/1972 | Hoffman | 24/16 |
| 3,654,669 | 4/1972 | Fulton | 24/16 |
| 3,721,750 | 3/1973 | Countryman | 174/135 |
| 3,747,163 | 7/1973 | Serino | 24/16 |
| 3,747,164 | 7/1973 | Fortsch | 24/16 |
| 3,748,699 | 7/1973 | Cunningham | 24/38 |
| 4,263,697 | 4/1981 | Speedie | 24/30.5 |
| 4,501,354 | 2/1985 | Hoffman | 206/77.1 |
| 4,557,023 | 12/1985 | Siex et al. | 24/16 |
| 4,566,158 | 1/1986 | Lau | 24/580 |
| 4,573,242 | 3/1986 | Lankton et al. | 24/16 |
| 4,577,375 | 3/1986 | Beaussant | 24/580 |
| 4,615,185 | 10/1986 | Bollinger | 63/5 |
| 4,665,588 | 5/1987 | Nakano | 24/16 |
| 4,680,834 | 7/1987 | Andre et al. | 24/16 |
| 4,788,751 | 12/1988 | Shely et al. | 24/16 |
| 4,862,561 | 9/1989 | Lichtenberg | 24/16 |
| 4,897,899 | 2/1990 | Shely et al. | 24/16 |
| 4,908,911 | 3/1990 | Bretti et al. | 24/16 |
| 4,976,017 | 12/1990 | Frano | 24/585 |
| 5,224,244 | 7/1993 | Ikeda et al. | 24/16 |
| 5,377,387 | 1/1995 | Freed . | |
| 5,395,343 | 3/1995 | Iscovich | 24/16 PB |
| 5,537,719 | 7/1996 | Freed . | |
| 5,758,390 | 6/1998 | Villeneuve | 24/16 PB |
| 5,884,367 | 3/1999 | Teagno et al. | 24/16 |
| 5,901,416 | 5/1999 | Mears | 24/16 PB |

FOREIGN PATENT DOCUMENTS

| | | |
|---|---|---|
| 845995 | 7/1970 | Canada . |
| 641916 | 12/1963 | France . |

*Primary Examiner*—Victor N. Sakran
*Attorney, Agent, or Firm*—Darby & Darby

[57] ABSTRACT

An extremely versatile tie which can; 1) be releasable or non-releasable; 2) tie one bundle or two bundles;, 3) be threaded from either side; 4) have a circular or oval shape; 5) have controlled release; and 6) attach to other ties so two or more ties can be opened in unison. This tie can be made out of one or more pieces. Each releasable tie has a strap, a holder, and a retainer, which can be in a locked or unlocked position. In the locked position, the tie can tighten in discrete increments, but cannot loosen. In the unlocked position, the tie can loosen or release in discrete increments (i.e., controlled release), but cannot tighten. The retainer and holder engage to keep the tie in either a locked or unlocked position. To ensure that the retainer and holder are not accidentally dislodged from the locked or unlocked position, a deliberate movement (perpendicular to the strap) is required by the user. This is accomplished by the user "lifting up" (or "pushing down", or "pushing in on") the holder (or retainer). After the retainer and holder are dislodged, the user may move the tie from a locked to an unlocked position (or visa versa) by either swiveling or sliding the holder (retainer or strap) to the other position. Swivel embodiments and slide embodiments are disclosed. One of the sliding embodiments slides lengthwise, the other slides crosswise. The holder of one swivel embodiment must be "lifted" to dislodge. The holder of another swivel embodiment must be "pushed down" to dislodge. Two or more ties may be attached so that the user can lock or unlock them in unison (i.e., requiring only one motion by the user).

29 Claims, 11 Drawing Sheets

MULTI-FUNCTION TIE

BACKGROUND OF THE INVENTION

1. Field of Invention

The present invention relates to ties, fasteners, straps or belts. More specifically, the present invention relates to a versatile tie that can be used to tie items, such as, for example, garments, packages, cables, orthopedic devices, footwear, luggage, etc. The ties of the present invention are stronger, more versatile, and less expensive, than any known ties.

2. Description of the Related Art

Conventional ties are commonly made of plastic, velcro, or cord. Plastic ties commonly contain a ratchet and pawl mechanism and are either releasable or non-releasable. Releasable ties are difficult to release because the pawl is difficult to access and actuate. Releasable ties are structurally different from non-releasable ties and, therefore, must be purchased separately. Ties that can hold two bundles are structurally different than ties that hold one bundle and, therefore, must also be purchased separately. Ties which form a circle are structurally different than ties which form an oval shape. Additionally, ties are only conventionally threaded one way.

Ties made of Velcro do not have a strong a gripping capability and tend to lose their gripping strength after repeated usage and/or laundering. Ties made of cord (such as laces) tend to come undone and wear out easily.

The multi-function ties of the present invention overcomes the above disadvantages of conventional plastic, velcro, and cord ties and have additional advantages that no known ties currently have.

SUMMARY OF THE INVENTION

Accordingly, it is an object of the present invention to produce a tie which is easy and inexpensive to manufacture and mold, yet is strong, durable, reliable, and easy to use.

It is a further object of the present invention to produce a tie which has many uses, so that the user will no longer need to buy and inventory different ties.

It is yet another object of the present invention to produce a tie that can be combined with one or more other ties so that only one motion is required from the user to lock (or unlock) all the ties.

It is still yet another object of the present invention to produce a versatile tie that is useful in multiple applications and industries.

According to several exemplary embodiments of a tie according to the present invention, these and further objects are achieved.

The same identical one piece tie in accordance with one embodiment of the present invention can be threaded from the left or right side, can form a round or oval shape, can hold one or two bundles, can be releasable or non releasable, and can have a controlled release.

The ties of the present invention are extremely versatile and, thus, have multiple functions. The ties may be of one or more pieces. The releasable and non-releasable one piece tie of the present invention are structurally identical. The user decides whether the tie will have a round or oval shape, from which side to thread the tie, whether the tie will hold one or two bundles, and whether the tie will be releasable or non-releasable. The tie may be molded out of one piece, therefore requiring no assembly. These benefits and features make the tie according to the present invention the most versatile and inexpensive tie known.

The one piece tie contains a strap, a holder and a retainer, which are all integrally attached to each other. The two piece tie contains either 1) a strap attached to a holder (the retainer is a separate); 2) a strap attached to the retainer (the holder is separate); 3) a retainer attached to a holder (the strap is separate—and can be cut from a roll so that it has a variable length). Of course, the tie may also be three pieces, in which case the strap, holder, and retainer are each separate. The tie may function as a releasable or non-releasable tie. When functioning as a non-releasable tie, the tie requires no separate retainer. The non-releasable tie can be used for virtually all uses that current non-releasable cable ties are used for. In addition to tying cables, the non-releasable tie can be used for ID bracelets, tags, and even handcuffs, etc. Some of the other uses of this tie are exemplified in my prior U.S. Pat. Nos. 5,377,387 and 5,537,719, all of which are hereby incorporated by reference, and include footwear (i.e., sneakers, roller blades, hiking boots etc.), sports equipment, luggage, orthopedic devices, garments, seat belts, etc. The current invention can also be used for "tie downs" or in the boating industry (sail boats etc.) where controlled release may be a benefit. It is believed that many other uses will be discovered as the extreme versatility and other benefits of this tie become apparent.

When locked, the ties of the present invention tighten in discrete increments, as conventional cable ties. When unlocked, the tie loosens in discrete increments related to the pressure from the inside of the strap (i.e., controlled release). By moving the retainer (or holder or strap), the user may easily change the tie from a locked position (where the tie cannot loosen, but can be tightened) to an unlocked position (where the tie cannot tighten, but can be loosened).

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings.

DETAILED DESCRIPTION OF THE PRESENTLY PREFERRED EXEMPLARY EMBODIMENTS

Referring now to FIGS. 1A–4B, a first exemplary embodiment of a one piece tie 100 in accordance with the present invention is illustrated. The one piece tie is molded in one piece and, therefore, requires no assembly. The ties shown in FIGS. 1A–2F are releasable (and reusable). The ties shown in FIGS. 3A–4B are non-releasable, but may be reusable.

Figure 1A:
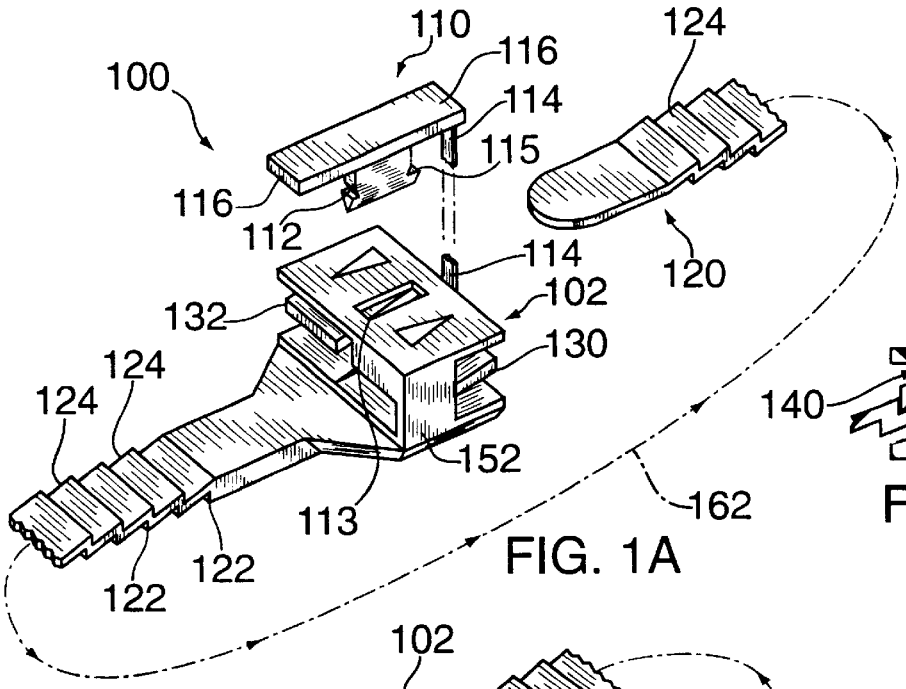
FIG. 1A is an exploded perspective view of a one piece tie in accordance with the present invention.
Figure 1B:
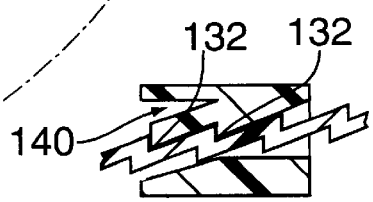
FIG. 1B is a cross-sectional view of the far side of the holder illustrated in FIG. 1C, with the strap inserted through the holder.
Figure 1C:
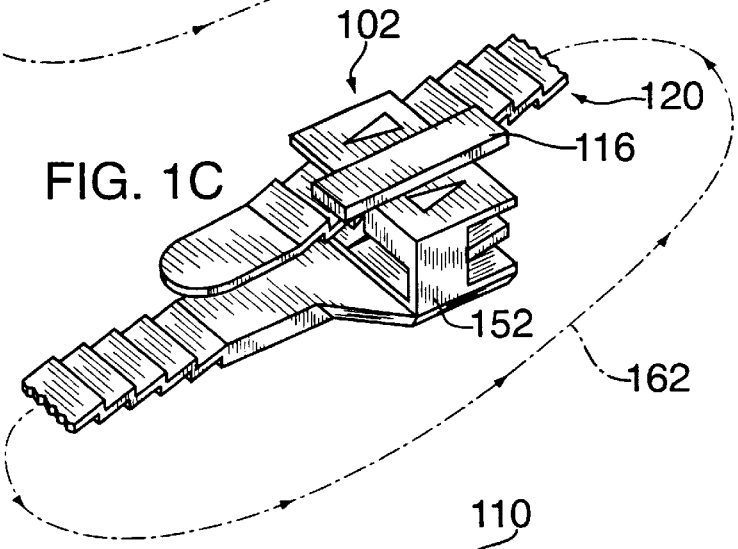
FIG. 1C is a perspective view of the one piece tie of FIG. 1A, threaded from the right side of the holder, and in the locked position.
Figure 1D:
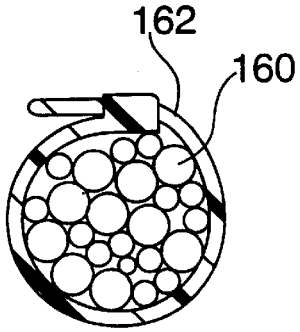
FIG. 1D is a cross-sectional view of the tie of FIG. 1A, in a circular shape.
Figure 1E:
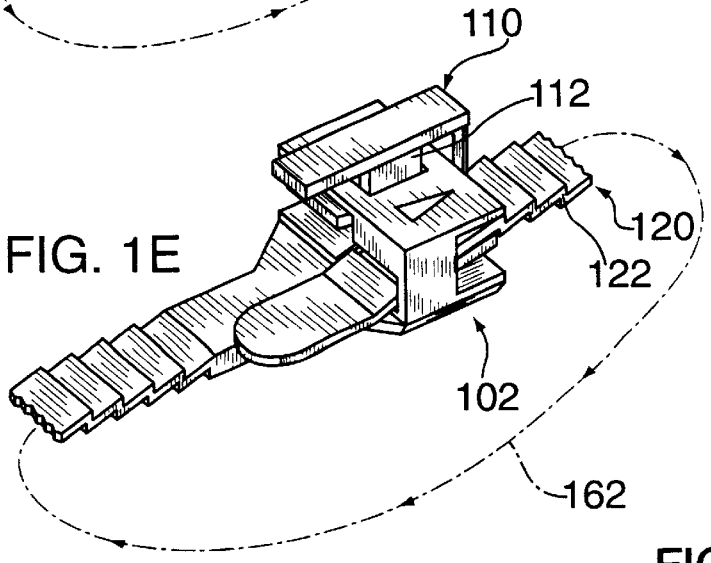
FIG. 1E is a perspective view of the tie of FIG. 1A, in the unlocked position.
Figure 1F:
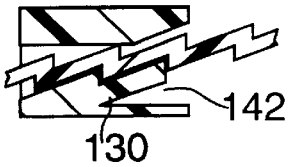
FIG. 1F/s a cross-sectional view of the near side of the holder of FIG. 1E, with the strap inserted through the holder.
Figure 1G:
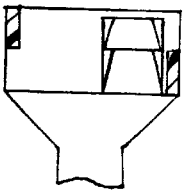
FIG. 1G is a cross-sectional view of the bottom of the holder of FIG. 1A.

A holder 102 is shown in FIGS. 1A–1G being threaded by a strap 120 from the right side of holder 102 and, thus, the tie has a rounded shape 162 (see FIG. 1D) around cables 160 (or other contents). The use of relative terms, such as, for example, right, left, far, near, etc. are with reference to the drawing figures to aid in describing the invention. Thus, the use of these relative terms is not to be construed as limiting the invention, but simply a tool to facilitate the reader in understanding the present invention. The interior of holder 102 has two sets of teeth, which are oriented in opposite directions. Each set of teeth extend for approximately half the width of holder 102. Teeth 132 are disposed on the upper inner surface of holder 102 (See FIG. 1B). Teeth 130 are disposed on the lower inner surface of holder 102 (See FIG. 1F). The arrows on top of the holder indicate which direction the strap can move when the strap is positioned under that arrow. When strap 120 is inserted through to the far side of the holder, as shown in FIGS. 1C, the strap can only move in the direction indicated by the arrow above it (i.e., the strap is locked and can only be tightened). When strap 120 is slid over to the near side of the holder, as shown in FIG. 1E, the strap can only move in the direction indicated by the arrow above it (i.e., the strap is unlocked and can only loosen). A retainer wall 112, perpendicular to the teeth in the holder, divides the holder into two parts, one part having the upper teeth and the other part having the lower teeth. The retainer wall 112 keeps strap 120 in either the locked or unlocked position. To slide the strap from an unlocked to a locked position and visa versa, retainer 110 is lifted up, preferably, by its sides 116, so that wall 112 moves up in a slot 113 in holder 102 to permit the strap to pass underneath it.

Retainer 110 is attached to holder 102 by a flexible web 114. After the user slides the strap to the other side of the holder, the user may then move the retainer wall 112 back down through slot 113, thereby preventing the strap from moving to the other side. The upper and lower teeth 132, 130 in the holder are sufficiently flexible due to notches 142, 140, respectively, to permit the strap to move in the direction indicated by the arrows on holder 102. Teeth 130, 132, therefore, have a spring like effect to make it easier for the strap to move in the direction of the arrow above it, and also more difficult to move in the opposite direction. The upper teeth 132 in the holder engage with the upper teeth on the strap 124 when the tie is being tightened. The lower teeth 130 in the holder engage with the lower teeth on strap 122 when the tie is being loosened.

The sides 116 of retainer 110 may snap into the sides of holder 102 to more securely hold the retainer in the installed position of FIG. 1C. Retainer wall 112 preferably has a stepped shoulder or a ridge 115 at its bottom so that wall 112 cannot be pulled all the way out of holder 102. To permit retainer wall 112 to be initially pushed into slot 113, the bottom of wall 112 is preferably tapered so that wall 112 will snap into slot 113 relatively easily. Holder 102 has side walls 152, which are partially cut away to simplify the molding of the internal teeth 130, 132 by eliminating undercuts.

Referring now to FIGS. 2A–2F, another embodiment of a tie 200 is illustrated. Tie 200 is similar tie 100, except for the retainer. Holder 202 is shown threaded from the left and, thus, the strap has an oval shape 262 around cables 260 (or other contents). Retainer 210, just as retainer 110, prevents the strap from moving from one side of the holder to the other. Holder 202 has two sets of teeth, which are oriented in opposite directions. Each set of teeth extend for approximately half the width of the holder. Teeth 230 are disposed on half of the lower inner surface of holder 202. Teeth 232 are disposed on half of the upper inner surface of holder 202.

Figure 2A:
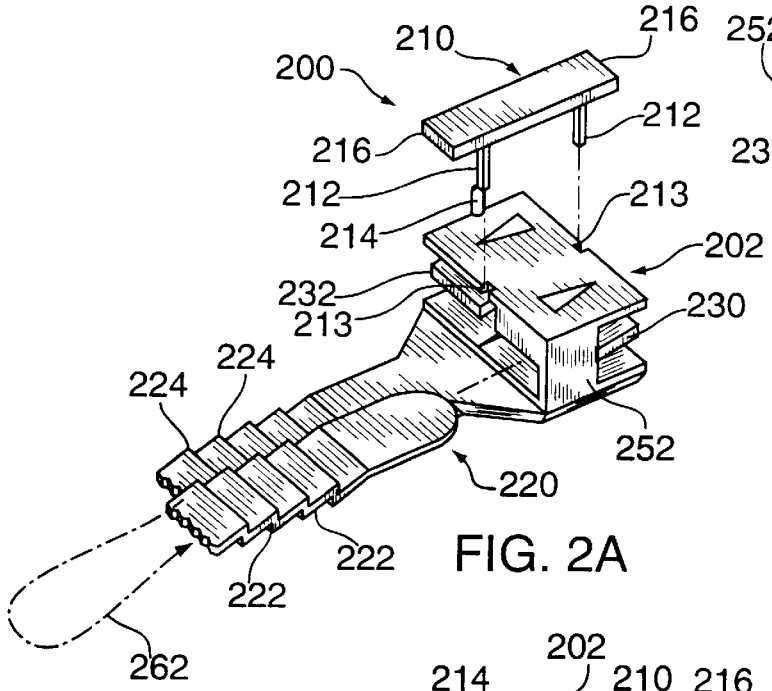
FIG. 2A is an exploded perspective of the one piece tie in accordance with another embodiment of the present invention.
Figure 2B:
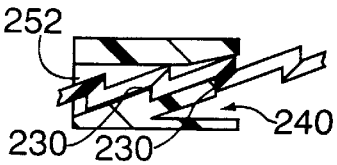
FIG. 2B is a cross-sectional view of the near side of the holder of the one piece tie of FIG. 2C, with the strap inserted through the holder.
Figure 2C:
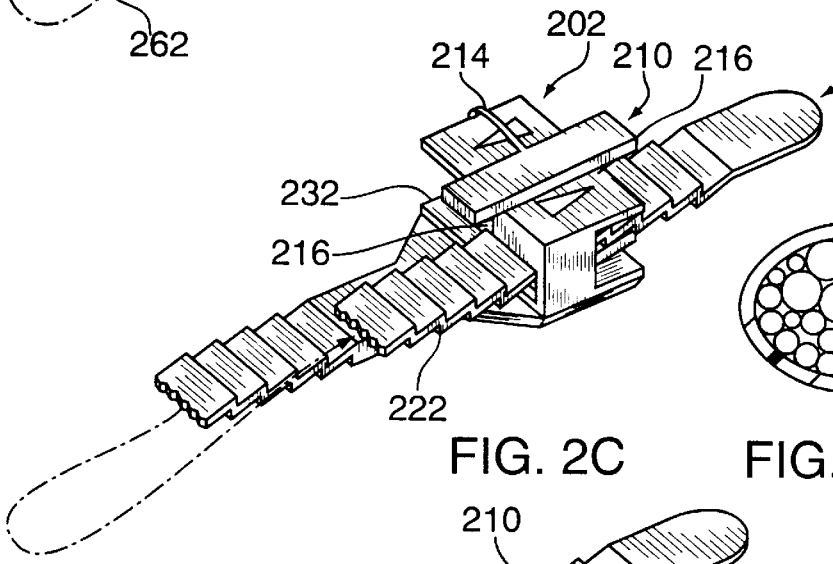
FIG. 2C is a perspective view of the one piece tie of FIG. 2A threaded from the left side of the holder, and in the locked position.
Figure 2D:
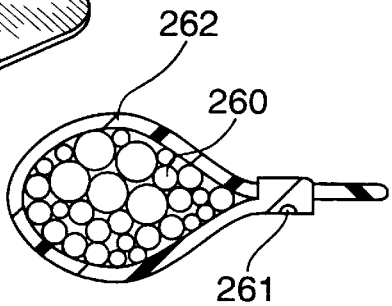
FIG. 2D is a cross-sectional view of the tie of FIG. 2A, in an oval shape.
Figure 2E:
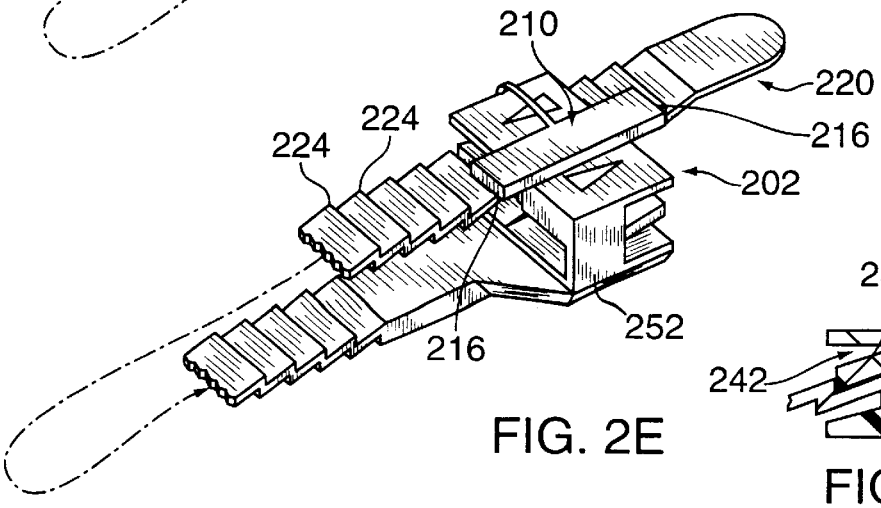
FIG. 2E is a perspective view of the tie of FIG. 2A, in the unlocked position.
Figure 2F:
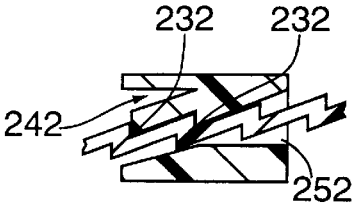
FIG. 2F is a cross-sectional view of the far side of the tie of FIG. 2E, with the strap inserted through the holder.

When strap 220 is on the near side of the holder (as viewed in FIGS. 2C), the strap is permitted to move in the direction indicated by the arrow above it (i.e., the strap is in the locked position and, therefore, can only be tightened). The strap is restricted in movement in the opposite direction because the teeth on the bottom of strap 222 engage with the teeth on the bottom of holder 230, as illustrated in FIG. 2B. When strap 220 is slid over to the far side of the holder, as viewed in FIG. 2E, the strap is permitted to it move in the direction indicated by the arrow above it (i.e., the strap is in the unlocked position and, therefore, can only be loosened). The strap is restricted in movement in the opposite direction because the teeth on the top of strap 224 engage with the teeth 232 on the top of holder 202, as illustrated in FIG. 2F. Retainer 210 has retainer legs 212, which keep the strap in one half of the holder, in either the locked or unlocked position. To slide the strap between the unlocked and locked position, retainer 210 is lifted with respect to holder 202, for example, by being grasped at protrusions 216, so that the legs 212 slide up in grooves 213. Retainer 210 is attached to holder 202 by a flexible web 214 (see FIGS. 2C and 2E). After the user slides the strap to the opposite side of the holder, the user may then slide the legs 212 of retainer 210 back down into grooves 213 in holder 202. When legs 212 of retainer 210 are inserted all the way down in grooves 213, legs 212 prevent the strap from moving to the other side of the holder. The strap is, thus, fixed in its locked or unlocked position. The upper and lower teeth in holder 232, 230 act as pawls because of notches 242, 240, which provide teeth 232, 230 with a spring like effect to permit the strap to move in a direction indicated by the arrow above it, and make it almost impossible for the strap to move in a direction opposite to the arrow. As the strap moves in the direction of the arrow, the strap teeth slide past holder teeth 230, 232, thereby making an audible click. Placing the strap in an oval shape is useful for hanging. The bottom of holder 202 may have a hole 261 to hang the tie (see FIG. 2D).

Referring now to FIGS. 3A–4B, another embodiment of the tie is illustrated. The ties of FIGS. 3A–4B differ from the previous embodiments in that the tie is configured by the user to be non-releasable by inserting the strap through the holder twice. Because the strap is inserted in both halves of the holder, both strands of the strap are prevented from moving to the other half of the holder. Thus, the tie is non-releasable. Tie 280 of FIGS. 3A,3B may be made reusable if the user cuts the strap anywhere in the locking loop 271, such as, for example, at location 270. Thereafter, end piece 274 can be pulled through the holder and discarded, thereby leaving an empty space in that half of the holder for the remaining strap within the holder to slide into, and be released. The user can insert more cables 278 (or any contents) and re-lock (or not re-lock) the tie by making another (shorter) loop. The retainers in FIGS. 1A–2F are movable. The retainer could also be non-movable, (i.e., a fixed divider). If the retainer is non-movable, the multifunction tie is non-releasable, can be threaded from either side, can form an oval or circular shape and can hold one or two bundles. Alternatively, the retainer can be omitted, and the strap can be inserted into the holder from both sides. In this arrangement each portion of the strap side within the holder prevents the other portion of the strap within the holder from sliding to the other side of the holder. Thus, in this arrangement, the multi-function tie is also non-releasable because, in effect, the strap acts as its own retainer.

Figure 3A:
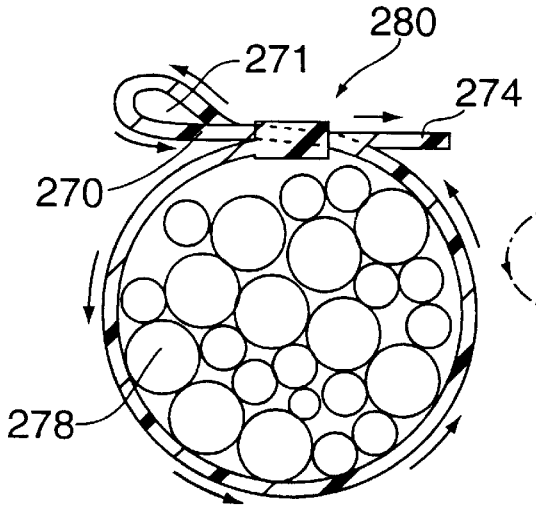
FIG. 3A is a cross-sectional view of the one piece tie threaded though the holder twice.
Figure 3B:
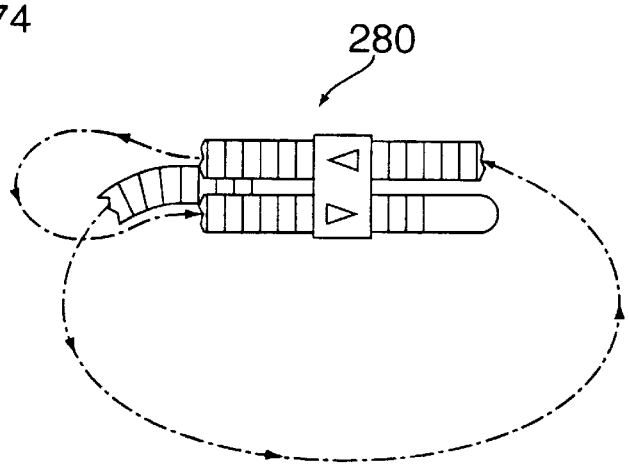
FIG. 3B is a top view of the tie shown in FIG. 3A.
Figure 4A:
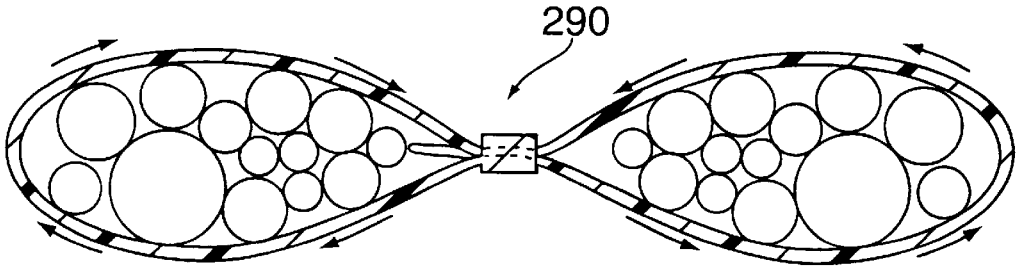
FIG. 4A is a cross-sectional view of the one piece tie threaded through the holder twice and holding ,two parallel bundles.
Figure 4B:
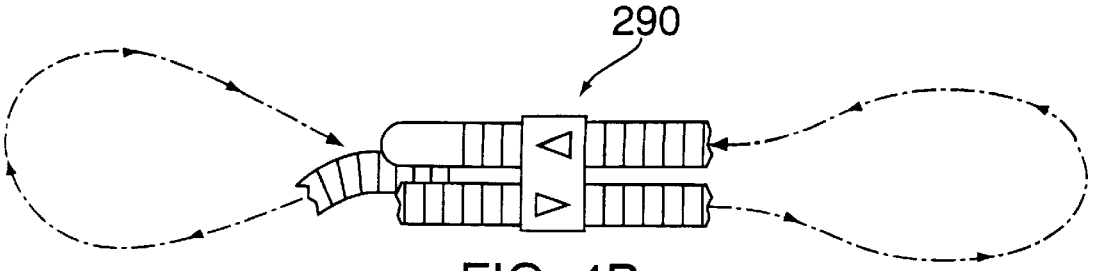
FIG. 4B is a top view of the tie shown in FIG. 4A.

FIGS. 4A and 4B show another use of the tie 290 holding two parallel bundles. The tie can be the one shown in FIGS. 1A–1G or 2A–2F. Depending upon how the tie is used by the user, it can be releasable or non-releasable, can hold one or two bundles, can be threaded from the left or right, can have a circular or oval shape, and can have a controlled release. Even though the tie in FIGS. 3A and 3B is non-releasable, it is still reusable. These functions do not exist in any other tie. Currently manufacturers and users need to buy and stock different ties for these different functions.

Ties 100, 200, 280 and 290 all have the same internal structure. Depending upon how the user decides to use the tie, the strap can be threaded from either direction and can, therefore, form a circular or oval shape. The sides of the holders are cut out to facilitate injection molding of the internal teeth (to eliminate undercuts) and to allow the tie to be easily molded in one shot. The ties can be releasable and non-releasable.

Figure 5A:
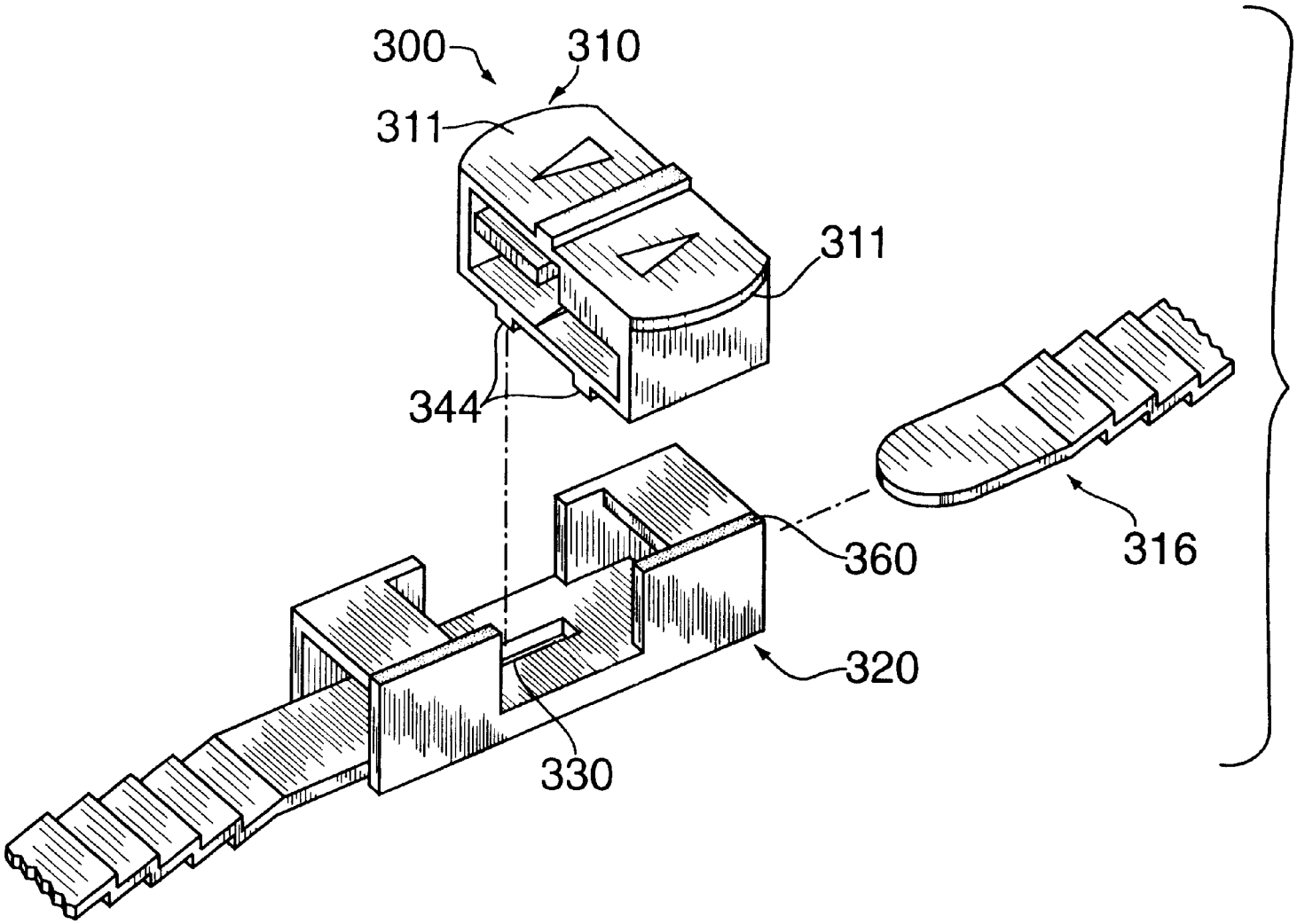
FIG. 5A shows an exploded partial perspective view of the two piece crosswise slide tie, holder, and retainer.
Figure 5B:
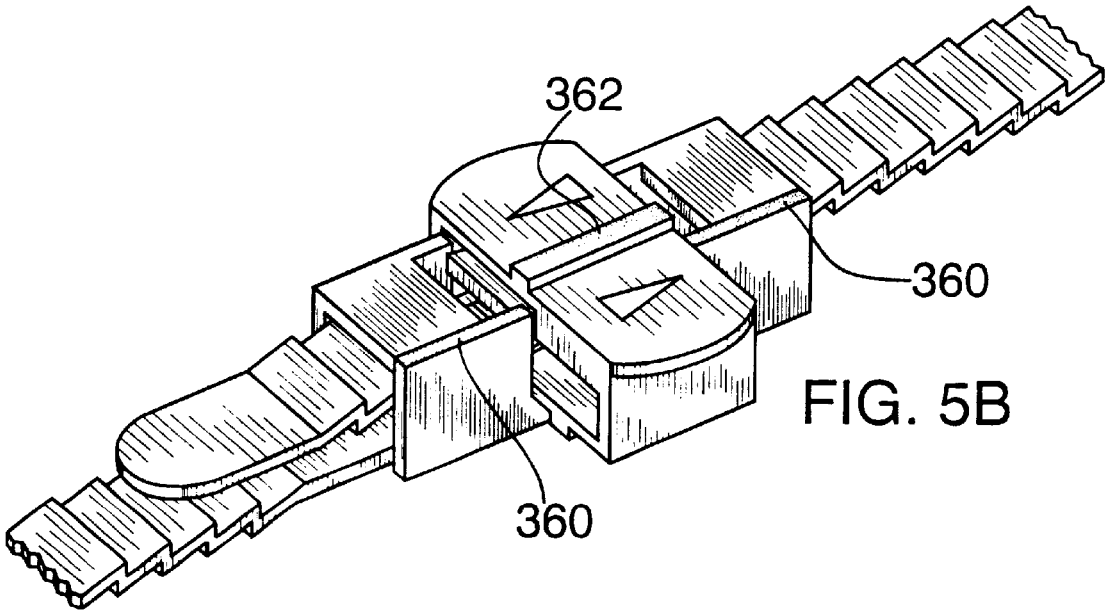
FIG. 5B is a partial perspective view of the two piece crosswise slide tie of FIG. 5A, in the locked position.
Figure 5C:
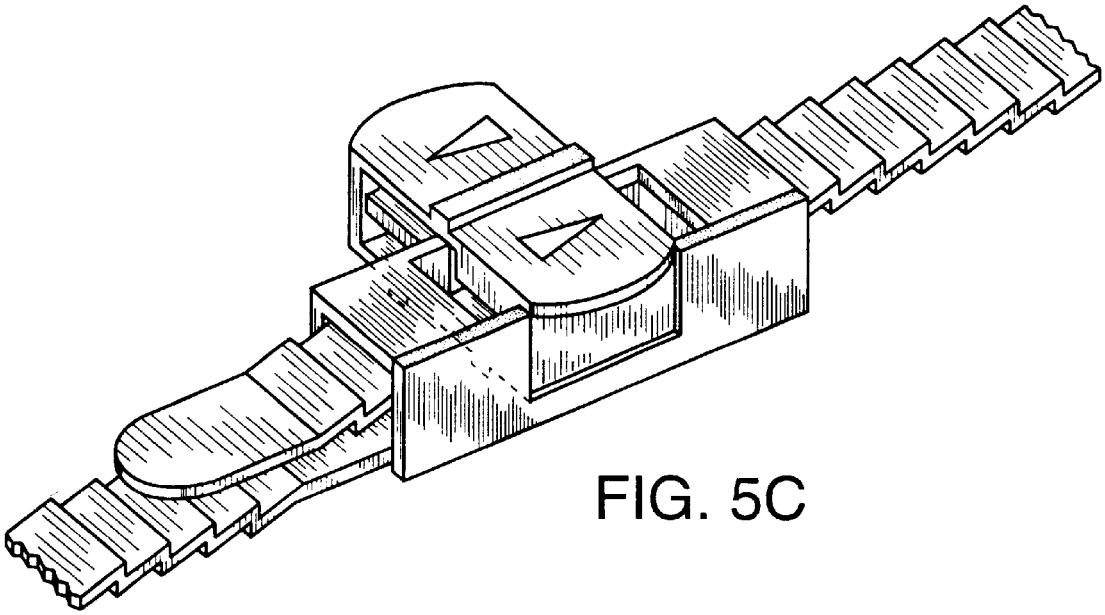
FIG. 5C is a partial perspective view of the two piece crosswise slide tie of FIG. 5A, in the controlled release or unlocked position.

Referring now to FIGS. 5A–5C, a two piece tie 300 is illustrated. One piece of tie 300 includes a strap 316 that is integrally attached to a retainer 320. The other piece of tie 300 is a holder 310. Holder 310 has two bars 344 depending downwardly from a lower outer surface of the holder. When the tie is in the locked position, one of the bars 344 engages with a slot 330 located on the bottom of retainer 320. The other bar 344 engages with slot 330 when the tie is in the unlocked position. To move the holder from a locked to an unlocked position, the user must disengage bar 344 by lifting the holder 310 (i.e., moving the holder perpendicularly away from the longitudinal direction of the extension of the strap) by the handles 311. When the tie is locked, FIG. 5B, a stripe 362 on the upper surface of holder 310 and the top stripes 360 on the upper surface of retainer 320 are aligned (see FIG. 5B). When the tie is unlocked, stripes 362, 360 are not aligned and the tie can loosen (i.e., move in the direction of the arrow above it, see FIG. 5C). Bars 344 are asymmetrical (i.e., bars 344 do not extend for the entire length of the holder) and will only fit into slot 330 (which likewise extends only so far as to receive bar 344, not the entire length of the holder) when the holder is properly oriented. If the holder 310 is reversed, bars 344 will not fit into slot 330, because the slot will not align with either bar, thereby ensuring that the orientation of the teeth in the holder with respect to the teeth on the strap is correct.

Figure 6:
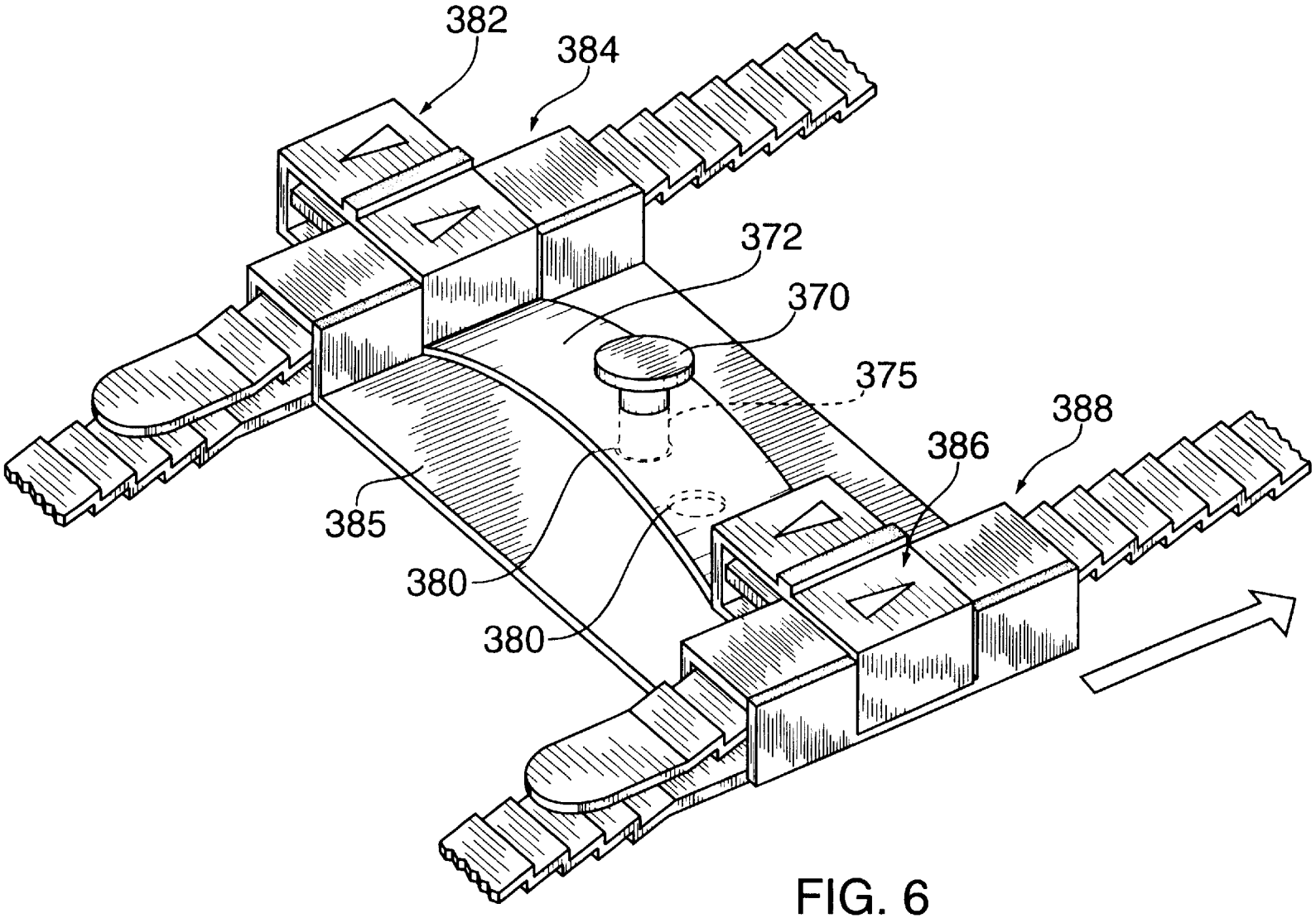
FIG. 6 is a partial perspective view of two attached cross-wise slide ties.

FIG. 6. shows another embodiment of the tie according to the present invention, which illustrates how two (or more) ties according to the FIGS. 5A–5C embodiment may be configured to move in unison (requiring only 1 movement from the user). Holders 382, 386 are integrally attached by a member 372 having a center handle 370 and a rod 375 directly underneath the handle 370. Member 385, which is attached to retainers 384, 388, has two holes 380 to receive rod 375. To move both straps in unison from a locked position to an unlocked position or visa-versa, the user lifts the handle 370 vertically out of one of the holes 380 to dislodge it, and slides the assembly, which includes holders 382, 386, to the unlocked position until rod 375 is aligned with the other hole 380. Thereafter, rod 375 is inserted into the other hole 380.

Figure 7A:
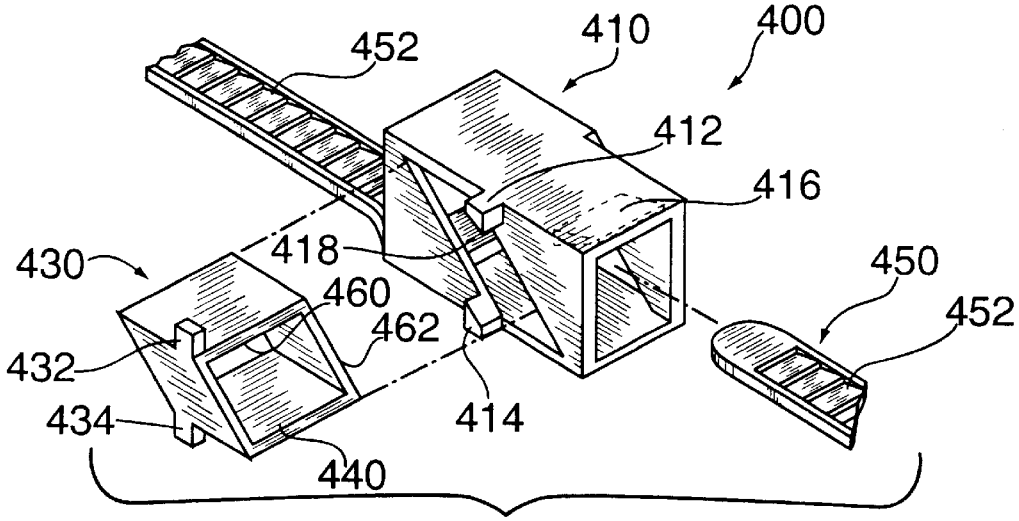
FIG. 7A is an exploded partial perspective view of the lengthwise slide tie.
Figure 7C:
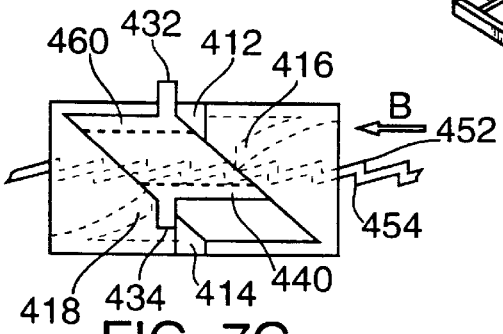
FIG. 7C is a side view of the retainer within the holder, with the retainer shown in the "up" or unlocked position.
Figure 7B:
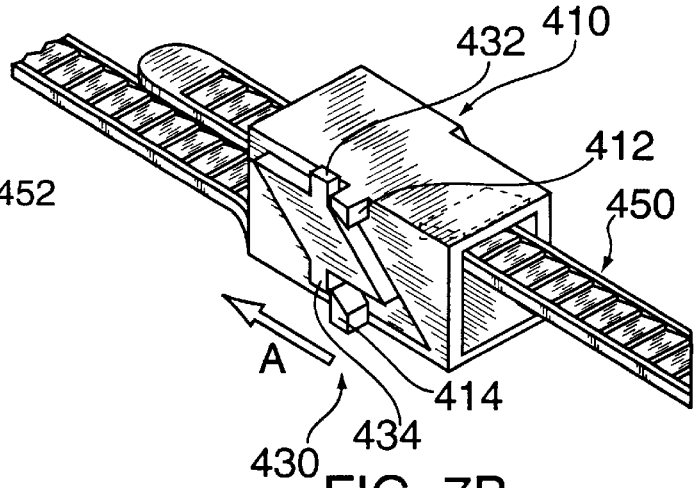
FIG. 7B is a partial perspective view of the assembled tie of FIG. 7A, with the retainer in the locked position.
Figure 7D:
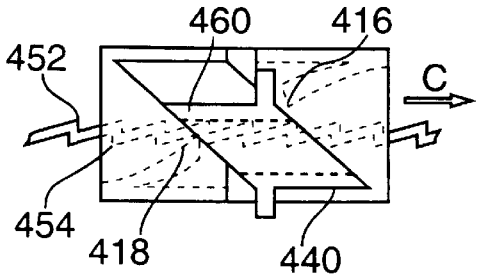
FIG. 7D is a side view of the retainer within the holder, with the retainer shown in the "down" or unlocked position.
Figure 7E:
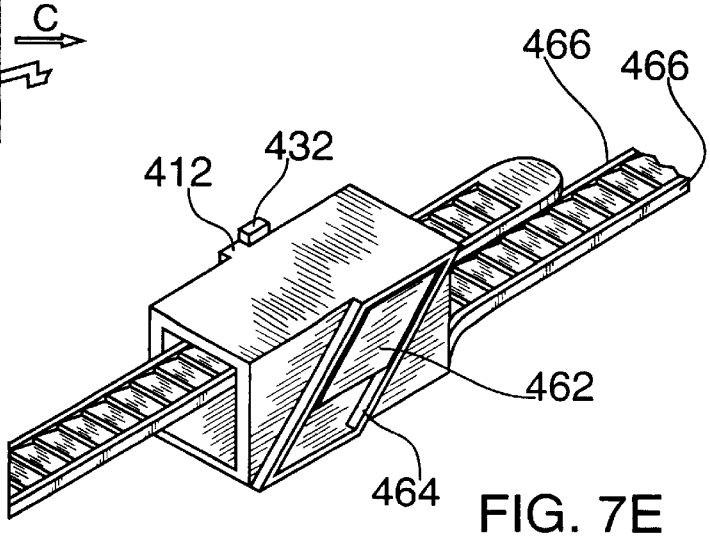
FIG. 7E is a partial perspective view of the assembled tie from side opposite to that of the of FIG. 7B.

Referring now to FIGS. 7A–7E, another embodiment of a two piece tie is illustrated. Retainer 430 slides in the direction of strap 450 (i.e., lengthwise) when moving from a locked to an unlocked position (or visa versa). Holder 410 has an internal tooth 416 depending from its upper surface and an internal tooth 418 depending from its lower surface on bottom. FIG. 7C shows strap 450 held in position against the top tooth 416 by the retainer floor 440. In this position, the strap bypasses the bottom tooth 418. The top teeth on the strap 452 mesh with tooth 416 so the strap can only move in the direction of arrow B (i.e., in a tightened or locked direction). FIG. 7D shows the strap 450 being held in position against the bottom tooth 418 by the retainer roof 460, which prevents the strap from contacting top tooth 416. The bottom teeth of the strap 454 mesh with tooth 418 so the strap can only move in the direction of arrow C (i.e., in a loosened or unlocked direction). Floor 440 or roof 460 of retainer 430 holds the strap in the upper (FIG. 7C) or lower (FIG. 7D) position, respectively. Retainer 430 is held in an upper or lower position within holder 410 by bosses 432, 434, which cannot bypass bosses 412, 414 on holder 410. To move retainer 430 past bosses 412, 414, the user must dislodge the retainer by pushing sidewall 462 of retainer 430 in sideways (i.e., perpendicular to the longitudinal direction of extension of the strap) to thereby permit the retainers bosses 432,434 to pass around the bosses 412, 414 on holder 410, after which the user can move retainer vertically up (or down) to the other position. A ridge 464 surrounds retainer wall 462, to ensure that the retainer is not accidentally dislodged. Ridge 464 also helps to keep the retainer 430 solidly in position. Strap 450 may have parallel borders 466 on each side to prevent the straps teeth from being damaged. Of course, straps on any of the other exemplary ties disclosed herein could also have borders 466 if desired, in which case the sides of the teeth in the holder may be beveled to ease transition from one position or the other, as those skilled in the art would readily recognize (see FIG. 1G).

Figure 8:
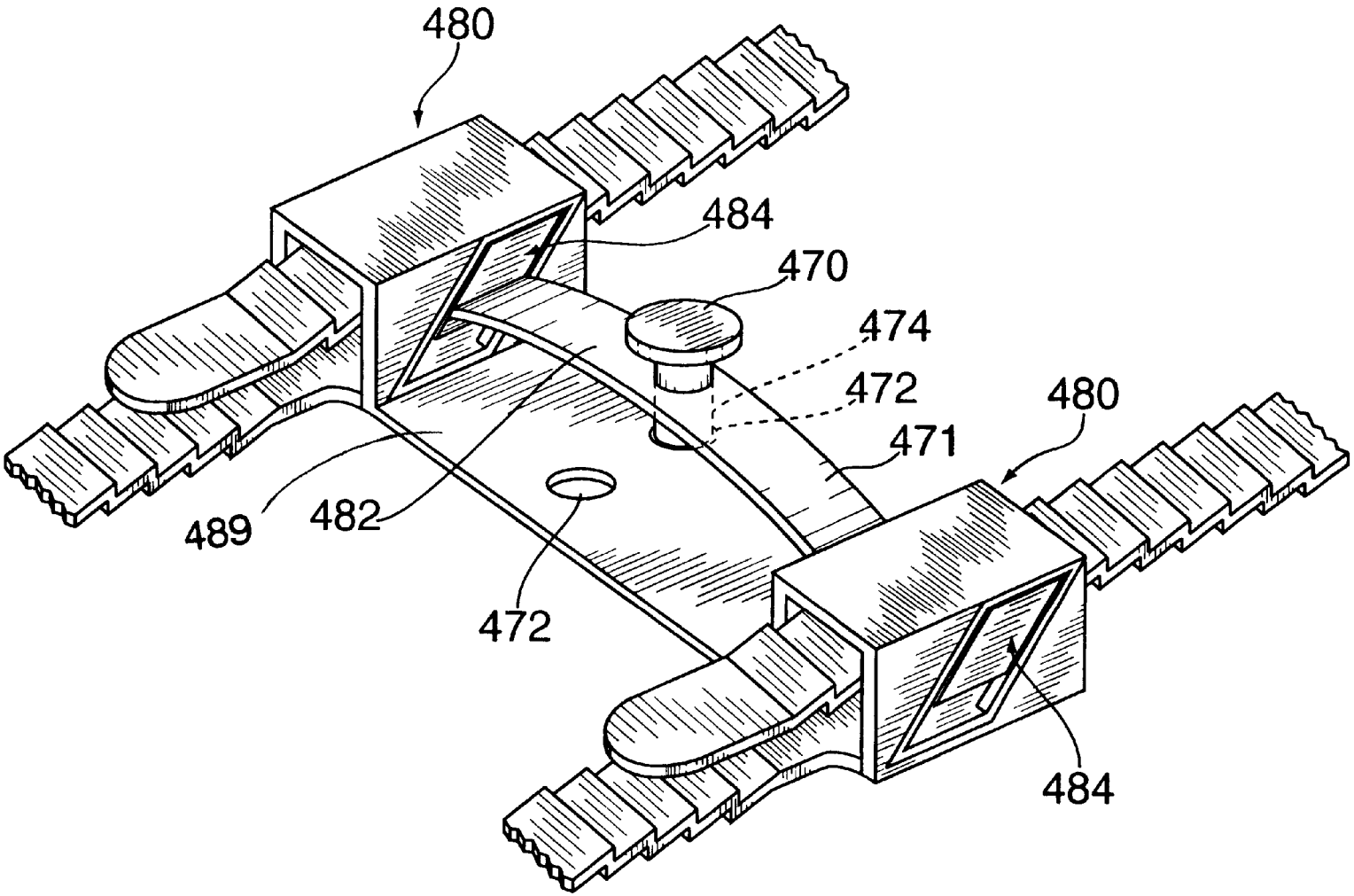
FIG. 8 is a partial perspective view of two lengthwise slide ties that are attached together.

FIG. 8 shows how two (or more) of the ties according to the FIGS. 7A–7E embodiment may be configured to move in unison. Retainers 484 are connected by an intermediate member 471, which has a handle 470 and a rod 474 fixedly connected to the handle. The holders 480 are connected by a base member 489. Base member 489 has two holes 472 located next to each other. To move two (or more) ties in unison from a locked to an unlocked position (or visa versa), the user must dislodge handle 470 from one of the holes 472 by lifting the handle 470. The assembly, including member 471, rod 474, handle 470, and retainers 484 is moved back (or forth) until rod 474 is aligned with the other hole 472. Thereafter, rod 474 is inserted into the other hole. Thus, both retainers 484 are moved in unison into an upper or lower position within their respective holders 480 and remain engaged until the user deliberately disengages them again.

Figure 9:
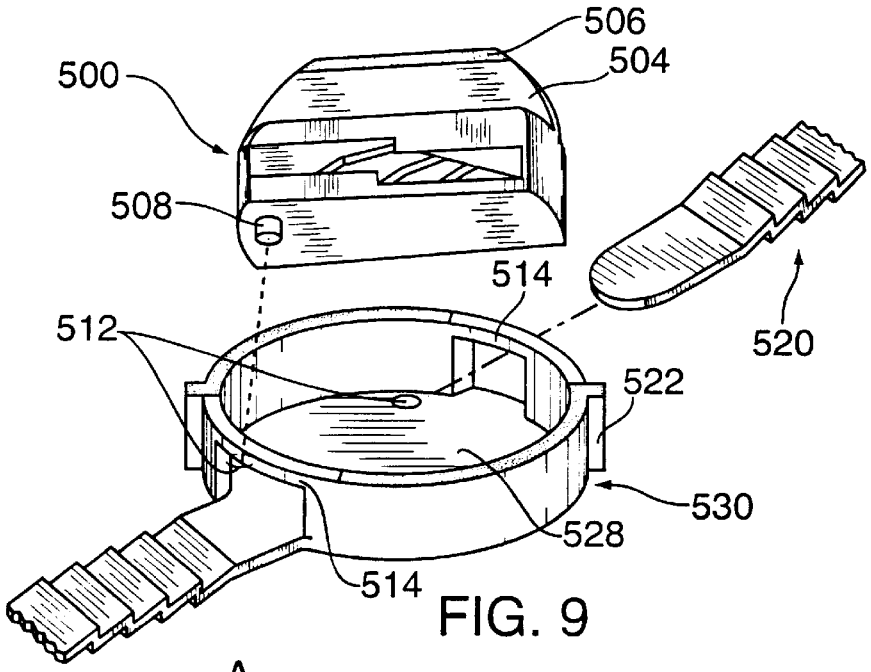
FIG. 9 is an exploded partial perspective view of the two piece lift swivel tie including the holder and retainer.
Figure 9A:
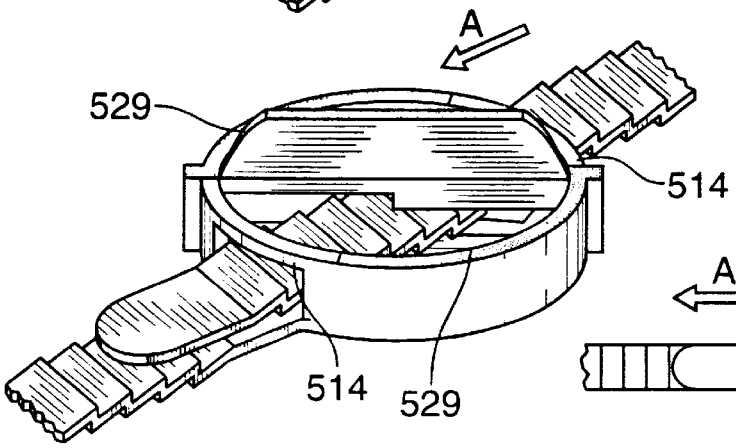
FIG. 9A is a partial perspective view of the two piece swivel tie in the locked position.
Figure 9B:
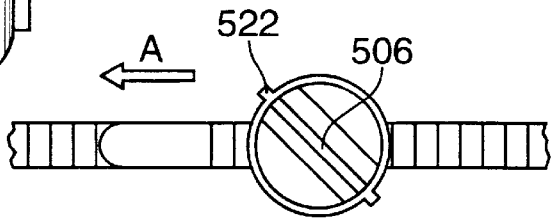
FIG. 9B is a top view of the tie shown in FIG. 9A.
Figure 9C:
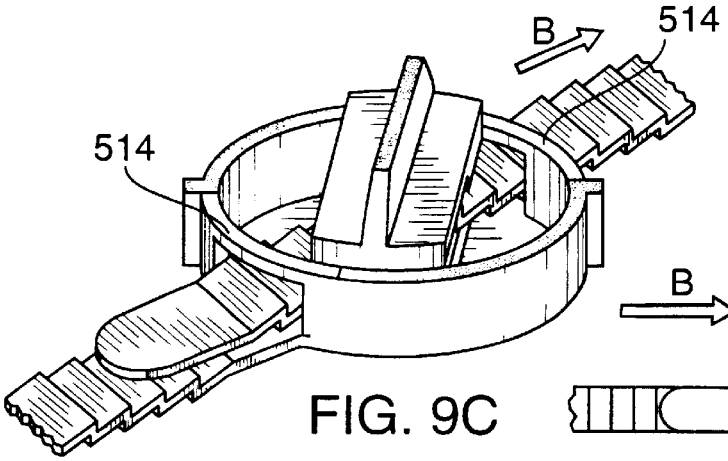
FIG. 9C is a partial perspective view of the two piece swivel tie in the unlocked position.
Figure 9D:
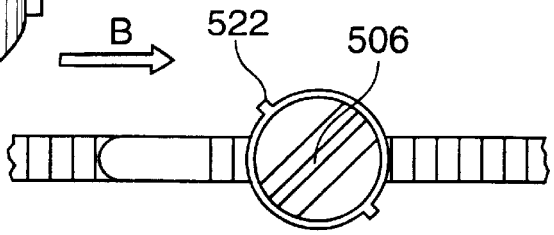
FIG. 9D is a top view of the tie shown in FIG. 9C.

FIGS. 9A–9D show a further embodiment of the present invention in the form of a two piece swivel or pivot tie. Strap 520 is integral with retainer 530. To move the tie between a locked and an unlocked position, the user must swivel holder 500 after it has been disengaged. To disengage holder 500, the user must first lift the holder vertically by handle 504 (i.e., in a direction perpendicular to the strap). A rod 508 engages with one of two holes 512 in retainer 530 when the holder 500 is in place. Holes 512 are located only on one side of the retainer floor 528 so that the holder will be oriented properly relative the strap. Handle 504 has a ridge 506, which helps the user in grasping when lifting. Ridge 506 aligns with indicators 522 to indicate when the tie is in the locked position (i.e., the strap can only be tightened by moving in the direction of arrow A). The user lifts holder 500 vertically by handle 504 and disengages rod 508 from hole 512. Thereafter, the user pivots holder 500 to the unlocked position at which point rod 508 may be lowered so that it engages with the other hole 512, as shown in FIG. 9C. The tie is now unlocked and can be loosened (move in direction of Arrow B). Retainer 530 has two portions 514 which surround strap 520 and keep it in place. FIGS. 9A and 9B show the tie in the locked position and the handle 506 aligned with protrusions 522. FIGS. 9C and 9D show the tie in the unlocked position and handle 506 out of alignment with protrusions 522. The arc created by the holder as it pivots back and forth could be colored as indicated by shading 529 in FIG. 9A.

Figure 10A:
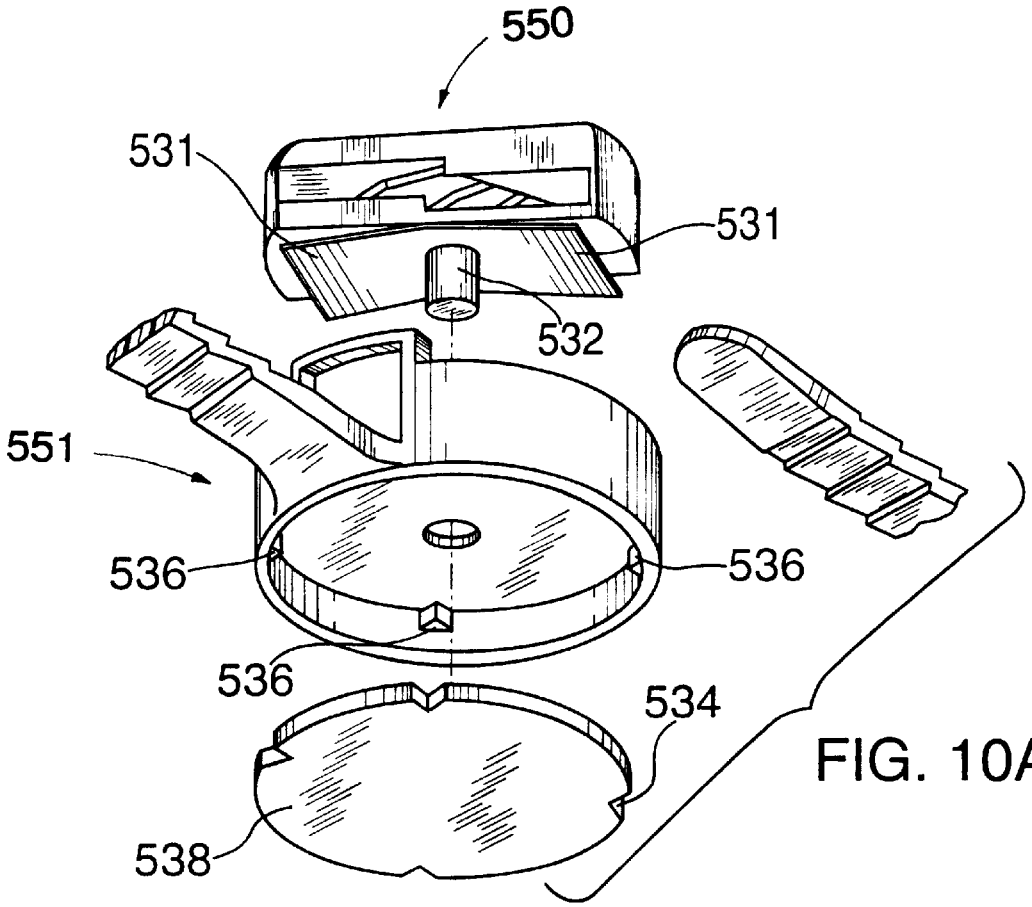
FIG. 10A is an exploded perspective view of the push down swivel tie, which includes a spring.
Figure 10B:
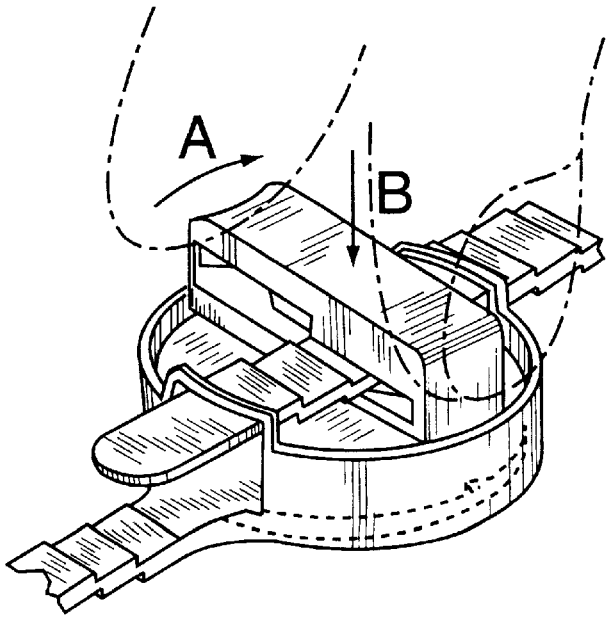
FIG. 10B is perspective view of the assembled swivel tie of FIG. 10A, showing, in phantom, a user pushing down and turning the holder to the unlocked position.

FIGS. 10A–10B show another embodiment of the pivot tie, which must be "pushed down" to disengage, and pivoting holder 550 from the locked position to the unlocked position (or visa versa). The bottom of holder 550 contains rod 532 which is attached to a disk 538. A pair of biasable flaps 531, which are in the form of a leaf spring, are mounted at the bottom of holder 550, about rod 532. Flaps 531 are compressed when the user pushes down on holder 550. This compression permits notches 534 in disk 538 to move under bosses 536, which bosses 536 project radially inwardly from an inner cylindrical surface of retainer 551. Once notches 534 move under bosses 536, a user may then pivot the holder 550 from a locked position to an unlocked position or vice versa. Holder 550 is attached to disk 538 as a one piece assembly. Of course, flaps 531 could be replaced by a compression spring or other biasable member. Additionally, disk 538 itself, could deform and serve as the biasable member. FIG. 10B shows the user pushing down on the holder 550 with his/her thumb and forefinger and then rotating the holder to the other position. Teeth (not shown) on the upper and lower inner surface of the holder engage with teeth on the top and bottom of the strap to enable the tie to either tighten or loosen.

Figure 11:
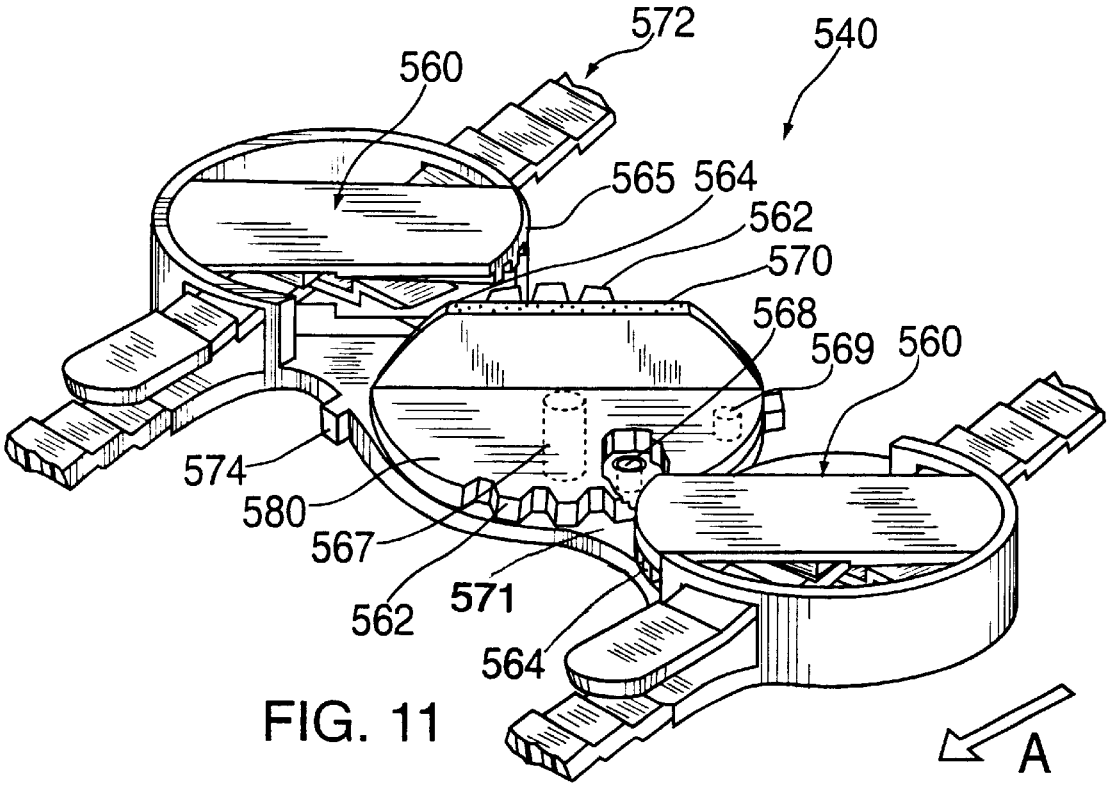
FIG. 11 is a partial perspective view of two attached swivel ties.
Figure 12A:
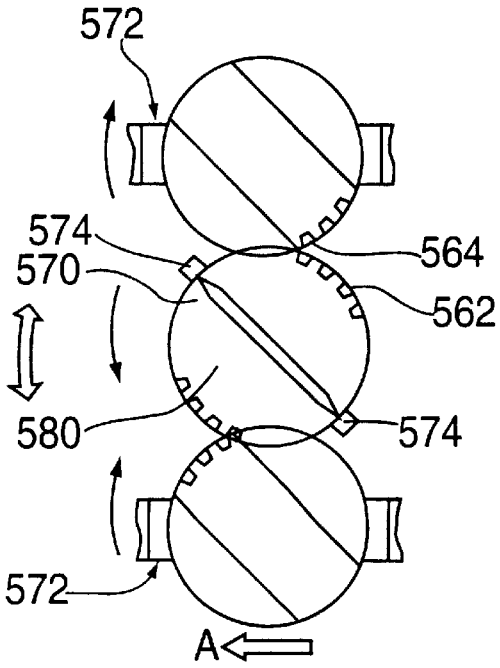
FIG. 12A is a top view of the ties of FIG. 11, in a locked position.
Figure 12B:
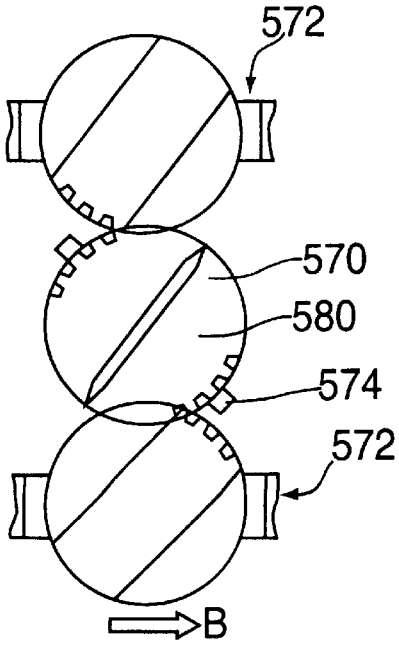
FIG. 12B is a top view of the ties shown in FIG. 11, in an unlocked position.

FIGS. 11–12B shows two pivot ties that are attached so they can move from a locked position to an unlocked position (or visa versa) in unison requiring only one movement from the user. The user first lifts a handle 570, which is attached to a center disk 580. Lifting handle 570 disengages a rod 568 depending downwardly from the lower surface of the disk 580 from a hole 569 in a base 571 and allows the user to rotate disk 580 to the other position. During rotation of disk 580, teeth 562 on the center disk 580 engage with teeth 564 on each of the holders 560 to allow the holders to alternately move from a locked position to an unlocked position (and vice versa). When handle 570 is lifted, teeth 562 lift until they are stopped by a ledge 565 on each of the holders above the teeth 564. As center disk 580 is rotated to the other position, rod 568 is aligned with hole 569. Center rod 567 permits the disk 580 to swivel back and forth and also holds it firmly in place. When handle 570 is aligned with protrusions 574, the ties are locked. When handle 570 is not aligned with protrusions 574 the ties are unlocked. FIG. 12A shows the ties in the locked position (i.e., both straps 572 move in the direction of arrow A so that they can only be tightened). FIG. 12B shows the ties in the unlocked position (i.e., both straps 572 move in the direction of arrow B so that they can only be loosened).

While the invention has been described as what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A multi-function tie comprising:

(a) a strap having a plurality of teeth;

(b) a holder including upper and lower members and a pair of connecting members, said connecting members connecting said upper and lower members;

(c) at least one upper tooth disposed on said upper member, said at least one upper tooth cooperates with said plurality of teeth of said strap so that when said strap and said holder are in a first position said strap is discretely ratchetable in a first direction;

(d) at least one lower tooth disposed on said lower member, said at least one lower tooth cooperates with said plurality of teeth of said strap so that when said strap and said holder are in a second position said strap is discretely ratchetable in a second direction, which is opposite to said first direction;

(e) a retainer selectively engaging with said holder to retain said strap in one of said first position and said second position; and wherein one of said holder and said retainer being movable perpendicularly with respect to a longitudinal direction of extension of said strap to permit movement of said strap between said first position and said second position.

2. A multi-function tie according to claim 1, wherein said at least one upper tooth is parallel to said at least one lower tooth.

3. A multi-function tie according to claim 2, wherein said holder moves sideways with respect to said strap during movement of said strap between said first position and said second position.

4. A multi-function tie according to claim 2, wherein said retainer moves lengthwise with respect to said strap during movement of said strap between said first position and said second position.

5. A multi-function tie according to claim 1, wherein said at least one upper tooth is disposed at an angle with respect to said at least one lower tooth.

6. A multi-function tie according to claim 5, wherein said holder pivots about an axis during movement of said strap between said first position and said second position.

7. A multi-function tie according to claim 1, wherein one of said holder and said retainer includes a male member and the other one of said holder and said retainer includes a female member, said male member selectively engages with said female member in one of said first position and said second position.

8. A multi-function tie according to claim 1, further including a holder orientation member that selectively engages with said holder and said retainer in said first position and said second position.

9. A multi-function tie according to claim 1, wherein said strap contains a border.

10. A multi-function tie according to claim 1, further comprising a handle on said holder.

11. A multi-function tie according to claim 1, further including a boss disposed on said retainer and a boss disposed on said holder, wherein said boss disposed on said holder engages with said boss disposed on said retainer to prevent movement of said retainer between said first position and said second position.

12. A multi-function tie according to claim 1, further comprising a spring member, wherein said spring member is biased during said movement of said strap between one of said first position and said second position.

13. A multi-function tie according to claim 1, wherein said retainer has an indicator and said holder has an indicator, said indicator on said retainer aligns with said indicator on said holder to indicate when said tie is in one of said first position and said second position.

14. A multi-function tie according to claim 1, wherein said at least one upper tooth is pawled and wherein said at least one lower tooth is pawled.

15. A multi-function tie according to claim 1, further comprising a second retainer, wherein said retainers are attached by an attachment member that includes a handle.

16. A multi-function tie according to claim 1, further comprising a second holder, wherein said holders are attached by an attachment member that includes a handle.

17. A multi-function tie according to claim 16, wherein said attachment member is integrally attached to said holders.

18. A multi-function tie according to claim 16, wherein said attachment member has a plurality of teeth, said holders each having a plurality of teeth, wherein said teeth on said attachment member engage with said teeth on each of said two holders.

19. A multi-function tie comprising:

(a) a strap having a plurality of teeth;

(b) a holder including upper and lower members and a pair of connecting members, said connecting members connecting said upper and lower members, said holder being comprised of two portions;

(c) at least one upper tooth disposed on said upper member of one of said two portions, said at least one upper tooth cooperating with said plurality of teeth of said strap so that said strap is discretely ratchetable in a first direction;

(d) at least one lower tooth disposed on said lower member on the other one of said two portions, said at least one lower tooth cooperating with said plurality of teeth of said strap so that said strap is discretely ratchetable in a second direction, which is opposite to said first direction; and (e) a retainer engaged with said holder thereby separating said holder into said two portions, said retainer selectively preventing movement of said strap from one of said two portions to the other one of said two portions.

20. A multi-function tie according to claim 19, wherein said at least one upper tooth is parallel to said at least one lower tooth.

21. A multi-function tie according to claim 19, wherein said retainer is fixed with respect to said holder.

22. A multi-function tie according to claim 19, wherein said retainer is a portion of said strap.

23. A multi-function tie according to claim 19, wherein said retainer selectively permits movement of said strap from said one of said two portions to the other one of said two portions.

24. A multi-function tie according to claim 23, wherein said retainer slidably engages with a slot in said holder.

25. A multi-function tie according to claim 24, wherein said retainer has a ridge for preventing removal of said retainer from said slot.

26. A multi-function tie according to claim 23, wherein said retainer and said holder are attached by a flexible member.

27. A multi-function tie according to claim 19, wherein said pair of connecting members have cut-outs therein to simplify molding.

28. A multi-function tie according to claim 19, further including a border on said strap.

29. A multi-function tie according to claim 28, wherein said at least one upper tooth and said at least one lower tooth are beveled.

* * * * *